US006976290B2

(12) United States Patent
Boyer et al.

(10) Patent No.: US 6,976,290 B2
(45) Date of Patent: Dec. 20, 2005

(54) HIDDEN HINGE FOR UTILITY VEHICLE BODY

(75) Inventors: Thomas J. Boyer, Wooster, OH (US); Doug L. Juga, Kenosha, WI (US)

(73) Assignee: Stahl/Scott Fetzer Company, Wooster, OH (US)

( * ) Notice: Subject to any disclaimer, the term of this patent is extended or adjusted under 35 U.S.C. 154(b) by 0 days.

(21) Appl. No.: 10/822,026

(22) Filed: Apr. 9, 2004

(65) Prior Publication Data

US 2005/0241107 A1 Nov. 3, 2005

(51) Int. Cl.[7] ..... E05D 11/10
(52) U.S. Cl. ..... 16/280; 16/334; 16/308; 16/297
(58) Field of Search ..... 16/280, 308, 333, 16/334, 262, 297; 296/57.1

(56) References Cited

U.S. PATENT DOCUMENTS

| | | | | |
|---|---|---|---|---|
| 3,727,971 A | | 4/1973 | Sisler | |
| 3,820,192 A | | 6/1974 | Nakano et al. | |
| 3,889,316 A | * | 6/1975 | Koike | 16/297 |
| 4,329,759 A | | 5/1982 | Lautenschläger | |
| 4,670,941 A | | 6/1987 | Peterson | |
| 4,690,468 A | | 9/1987 | Lau | |
| 4,807,331 A | * | 2/1989 | Calucci | 16/262 |
| 4,815,164 A | | 3/1989 | Rottinghaus | |
| 4,864,687 A | * | 9/1989 | Calcaterra et al. | 16/237 |
| 4,917,430 A | | 4/1990 | Lawrence | |
| 5,272,789 A | | 12/1993 | Mitchell et al. | |
| 5,575,037 A | * | 11/1996 | Tolle et al. | 16/334 |
| D385,224 S | | 10/1997 | Aros et al. | |
| 5,675,869 A | * | 10/1997 | Lotz | 16/334 |
| 5,750,236 A | | 5/1998 | Aros et al. | |
| 5,794,309 A | * | 8/1998 | Lotz | 16/334 |
| D407,044 S | | 3/1999 | Aros et al. | |

(Continued)

OTHER PUBLICATIONS

*Hinges for construction of automobiles, utility vehicles and agricultural machines*, website printout http://www.kaltenbach-scharniere.de/html/e/sonderanfertigung/automobil-bau.html, dated Mar. 26, 2004.
*Stahl Brochure—Grand Challenger, Service Bodies*, dated Feb. 2002.

*Primary Examiner*—Brian E. Glessner
*Assistant Examiner*—Mark Williams
(74) *Attorney, Agent, or Firm*—Pearne & Gordon LLP

(57) ABSTRACT

An inventive hinge has the ability to be biased toward open and closed positions and/or is adapted to be hidden in door assemblies. The hinge includes a first bracket adapted to be mounted to a first workpiece. The first bracket comprises a generally tubular sleeve and opposed spaced-apart surfaces including first openings that are aligned with each other. A second bracket is adapted to be mounted to a second workpiece. The second bracket comprises opposed spaced-apart surfaces including second openings that are aligned with each other. The first bracket and the second bracket are oriented with respect to each other effective to align the first openings with the second openings. A hinge pin is received in the first and second openings effective to enable the first bracket to be pivotally movable relative to the second bracket. The tubular sleeve extends from the first bracket generally parallel with an axis of the hinge pin. A spring has a serpentine geometry and a generally L-shape along the hinge pin axis when in a relatively stable state. Also featured are door assemblies comprising the hinges and articles that include the door assemblies including motor vehicle bodies and tool boxes.

14 Claims, 6 Drawing Sheets

U.S. PATENT DOCUMENTS

D407,045 S 3/1999 Aros et al.
D407,046 S 3/1999 Aros et al.
D414,137 S 9/1999 Aros et al.
D414,139 S 9/1999 Aros et al.
5,988,724 A * 11/1999 Wolda ..... 296/57.1
6,648,398 B2 * 11/2003 Duffy ..... 296/146.11

* cited by examiner

HIDDEN HINGE FOR UTILITY VEHICLE BODY

FIELD OF THE INVENTION

The present invention relates to the field of spring loaded hinges. In particular, a specific aspect of the invention relates to hinges that can be hidden and are suitable for use in door assemblies of motor vehicles.

BACKGROUND OF THE INVENTION

Utility vehicles include utility bodies mounted to the rear of the chassis of vehicles. The utility bodies have a plurality of storage compartment units covered by exterior doors. Utility vehicles are used by companies that have a need for storage, such as telephone companies, electric companies, general contractors, repair companies and the like.

Utility bodies are mounted onto an OEM pick-up truck chassis with a cab and no bed. The utility body is mounted onto the rear portion of such chassis in place of the bed. The utility body is provided with a style and color that complements the cab. Utility bodies can have various designs with different numbers, sizes and locations of compartments.

Utility bodies typically comprise a pair of body side storage compartment units mounted along rear side portions of the chassis. The storage compartment units are typically made of metal and comprised of various front, rear, top, bottom and other panels which are interconnected by welding. The panels form separate compartments that lead to outer door openings. Door assemblies cover the door openings and include visible hinges.

Door assemblies for a variety of applications could benefit from hidden hinges and from improved spring-loaded hinges which tend to remain open and closed. In particular, motor vehicles, including automobiles, trucks and utility vehicles, could also benefit from hidden door hinges. It would be especially useful for the hinge to bias vehicle doors into open and closed positions to reduce the effect of environmental conditions, such as wind, on the doors. A further benefit would be a door assembly employing a simple hinge construction that biases the door without pneumatic or hydraulic devices.

SUMMARY OF THE INVENTION

In general, the present invention is directed to a hinge that has the ability to be biased toward open and closed positions and/or is adapted to be hidden in door assemblies. The hinge includes a first bracket adapted to be mounted to a first workpiece. The first bracket comprises a generally tubular sleeve and opposed spaced-apart surfaces including first openings that are aligned with each other. A second bracket is adapted to be mounted to a second workpiece. One of the workpieces is adapted for pivotal movement relative to the other fixed workpiece. The second bracket comprises opposed spaced-apart surfaces including second openings that are aligned with each other. The first bracket and the second bracket are oriented with respect to each other effective to align the first openings with the second openings. A hinge pin is received in the first and second openings effective to enable the first bracket to be pivotally movable relative to the second bracket. The tubular sleeve extends generally parallel with an axis of the hinge pin. A spring has a serpentine geometry and a generally L-shape in a direction of the hinge pin axis when the spring is in a less-compressed state. Compression of the spring produces a resultant spring force that urges the hinge closed or open.

A door assembly includes the door to which a set of the hinges is connected. The first workpiece may be comprised of the door and the second workpiece may be comprised of a fixed surface to which the door can be pivotally connected. The door assembly preferably comprises a set of hinge cavities in internal surfaces of a periphery of the door. The hinge cavities are configured to receive the hinge pins within the door effective to enable the hinges to be hidden by the door in its open and closed positions.

Turning now to more specific details of the spring, the spring comprises first and second end portions. The first end portion is pivotally received in the sleeve and extends generally parallel with the hinge pin. The second end portion is fixed to the second bracket and extends generally parallel with the hinge pin. In particular, the spring can be made of metal wire such as steel which tends to retain its form. The spring comprises a first generally inverted U-shaped portion including a first leg, a second leg and a first intermediate portion. The first leg is located at the first end portion received by the sleeve. The second leg is generally parallel with the first leg. The first intermediate portion extends transversely between the first and second legs. A second U-shaped portion includes the second leg, a third leg and a second intermediate portion. The third leg contacts the second bracket and extends generally parallel to the second leg. The second intermediate portion extends transversely between the second and third legs. The first generally inverted U-shaped portion extends transversely to the second generally U-shaped portion to form the generally L-shape from above when the spring is in the less compressed state.

An imaginary center reference line extends transversely between the hinge axis and an axis of the second end portion of the spring. When the first bracket is pivoted relative to the second bracket the first end portion of the spring disposed in the sleeve travels in a substantially arcuate path around the hinge pin axis between open and closed positions of the hinge. Movement of the hinge between the open and closed positions that locates the first end portion near the center line (on center) reduces a distance between the first end portion and the second end portion, thereby generating greater compression on the spring (i.e., between the first movable and second generally fixed end portions of the spring) and a greater spring force that urges the first end portion away from the center line (over center) and the hinge toward one of the open and closed positions. The spring can bias the hinge and door assembly toward the open position when the first end portion of the spring is on the path between the open position and the centerline. The spring can bias the hinge and door assembly toward the closed position when the first end portion of the spring is on the path between the centerline and the closed position. Thus, the hinge is biased toward the open and closed positions. Furthermore, to move the spring from the fully open and fully closed positions a compressive force is applied to the first spring end portion toward the second spring end portion which exceeds the force exerted by the second spring end portion against the first spring end portion.

Various articles that employ the door assembly are covered by the invention, including bodies of motor vehicles, tool boxes, and any applications in which it is desired to conceal a hinge and/or to employ a door assembly which is biased toward closed and open positions as discussed below. In the body of a motor vehicle comprising door openings the inventive door assembly is pivotally connected to a surface of the body so as to cover one or more of the door openings. Suitable motor vehicles include automobiles, trucks, utility vehicles or sports utility vehicles. In the tool box, the inventive door assembly is pivotally connected to the tool box so as to cover a door opening of the tool box. The tool box can be adapted to be mounted across a bed of a pick-up truck.

A preferred embodiment of the present invention is directed to a utility body adapted to be mounted to a truck chassis of a utility vehicle. The utility body includes body side storage compartment units comprising door openings. Doors cover the door openings, each door including a set of hinge cavities in internal surfaces of a periphery of the door. A set of the hinges pivotally connect the doors to the storage compartment units with a bias toward open and closed positions. Each of the hinges comprises the first bracket mounted to the door. The first bracket comprises the generally tubular sleeve and the opposed spaced-apart surfaces including the first openings that are aligned with each other. The second bracket is mounted to the body side storage compartment units. The second bracket comprises the opposed spaced-apart surfaces including the second openings that are aligned with each other. The first and second brackets are oriented with respect to each other effective to align the first openings with the second openings. The hinge pin is received in the first and second openings effective to enable the first bracket to be pivotally movable relative to the second bracket. The tubular sleeve extends generally parallel with the hinge pin axis. The spring has the serpentine geometry and generally L-shape as seen along the hinge pin axis, when the spring is in a less compressed state. The spring comprises the first and second end portions. The first end portion is pivotally received in the sleeve and extends generally parallel with the hinge pin and the second end portion contacts the second bracket and extends generally parallel with the hinge pin. The center reference line extends transversely between the hinge axis and the axis of the second end portion of the spring. When the first bracket is pivoted relative to the second bracket, the first end portion of the spring disposed in the sleeve travels in the substantially arcuate path around the hinge pin axis between the open and closed positions of the hinge. Movement of the hinge between the open and closed positions that locates the first end portion near the center line (on center) reduces the distance between the first and second end portions thereby generating the spring force that urges the first end portion away from the center line (over center) and the hinge toward one of the open and closed positions. The hinge cavities are configured to receive the hinge pins within the doors effective to enable the hinges to be hidden by the doors in their open and closed positions.

Advantages of using the inventive door assembly on motor vehicles are that the hinge can be concealed as well as maintained in open and closed positions. Concealing the hinge is desired in that it improves the aesthetics of the vehicle as compared, for example, to conventional utility bodies in which the hinges are visible and can detract from the appearance of the vehicle. Maintaining the hinge open or closed is desirable in motor vehicles, and in utility vehicles in particular, to resist forces arising from environmental conditions in which such vehicles are used, such as high wind and steep road inclinations. Such conditions can cause doors to be opened or closed unintentionally and can result in damage to the door, tools or other equipment in the storage compartment, and to nearby vehicles.

Many additional features, advantages and a fuller understanding of the invention will be had from the following description of the drawings and detailed description that follows.

DETAILED DESCRIPTION

Figures 1, 2:
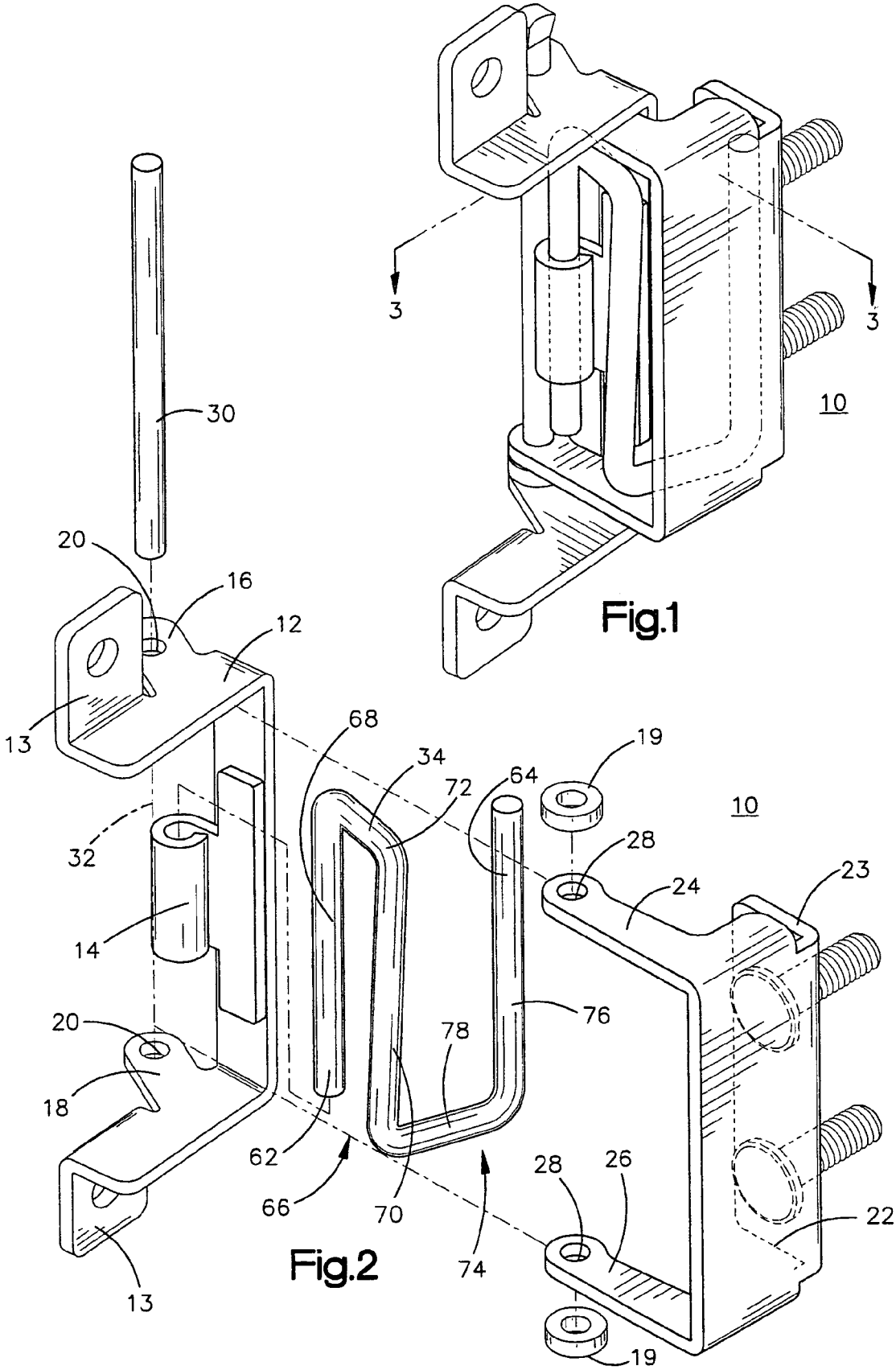
FIG. 1 is an elevational view showing a hinge constructed in accordance with the present invention.
FIG. 2 is an exploded view of the hinge of FIG. 1.

Turning now to the drawings, FIGS. 1 and 2 show a hinge 10 constructed in accordance with the present invention that has the ability to be biased toward open and closed positions. As will be discussed below, the hinge is also adapted to be hidden in door assemblies. The hinge includes a first C-shaped bracket 12 adapted to be fastened to a first workpiece at ears 13. The first bracket comprises a generally tubular sleeve 14 and opposed spaced-apart surfaces 16, 18 including first openings 20 that are aligned with each other. A second C-shaped bracket 22 is adapted to be fastened to a second workpiece at surface 23. The second bracket comprises opposed spaced-apart surfaces 24, 26 including second openings 28 that are aligned with each other. The surfaces 24, 26 of the second bracket are spaced apart by a shorter distance than the surfaces 16, 18 of the first bracket. The first bracket and the second bracket are oriented with respect to each other effective to align the first openings with the second openings. A hinge pin 30 is fixed in the first and second openings 20, 28 effective to enable the first bracket to be pivotally movable relative to the second bracket. Spacer rings 19 receive the hinge pin and are disposed between the first and second brackets to facilitate pivoting. The tubular sleeve is mounted to or integrally formed on the first bracket; it can be located adjacent to and extend generally parallel with an axis 32 of the hinge pin. A spring 34 has a serpentine geometry and a generally L-shape as seen in the top view of FIGS. 3–5 (i.e., along the hinge pin axis) when in a less-compressed or relatively stable state.

Figure 3:
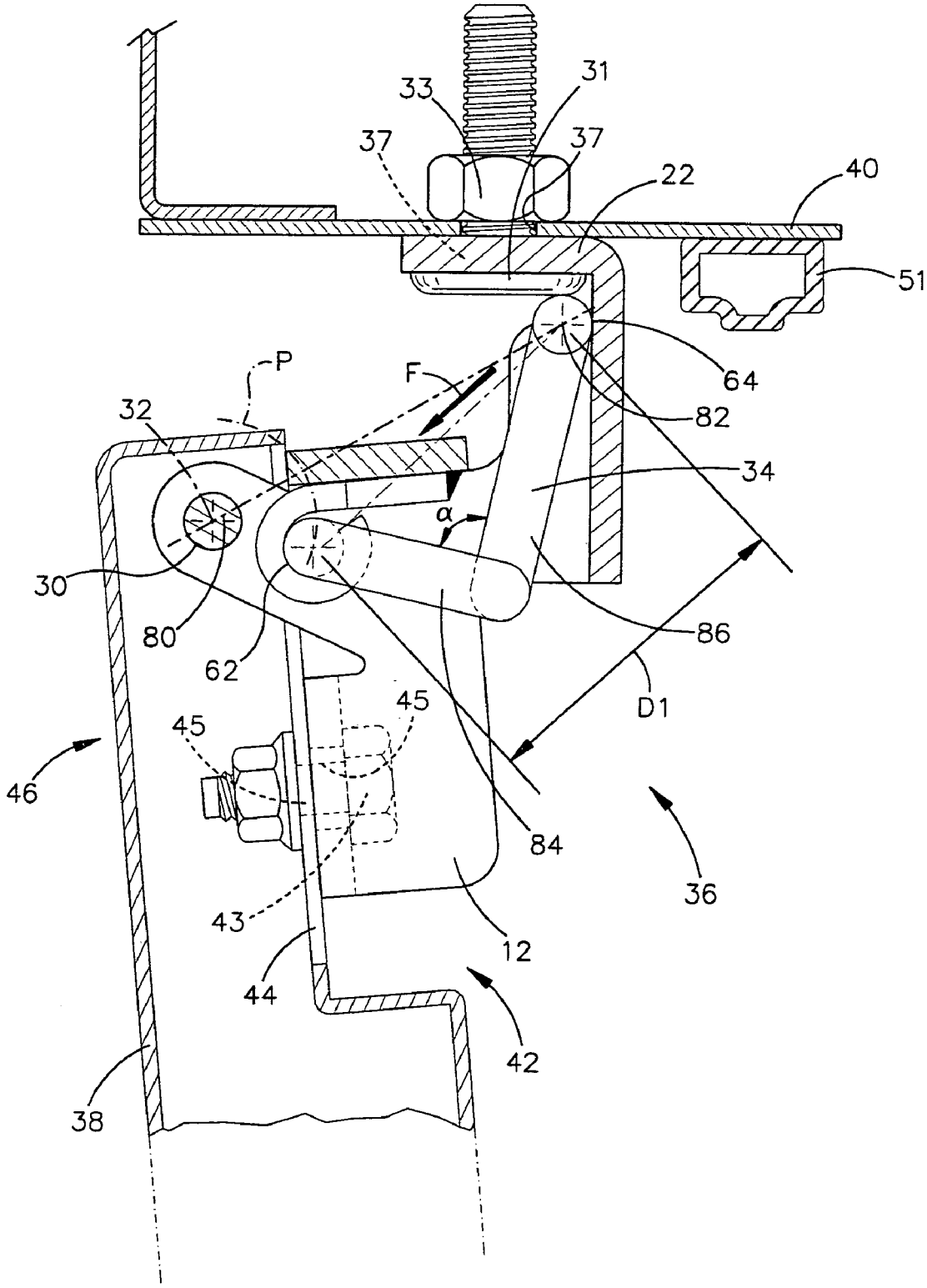
FIGS. 3–5 are top plan sectional views showing a door assembly comprising the hinge moving between open and closed positions, as seen along lines and arrows 3—3 in FIG. 1.
Figure 5A:
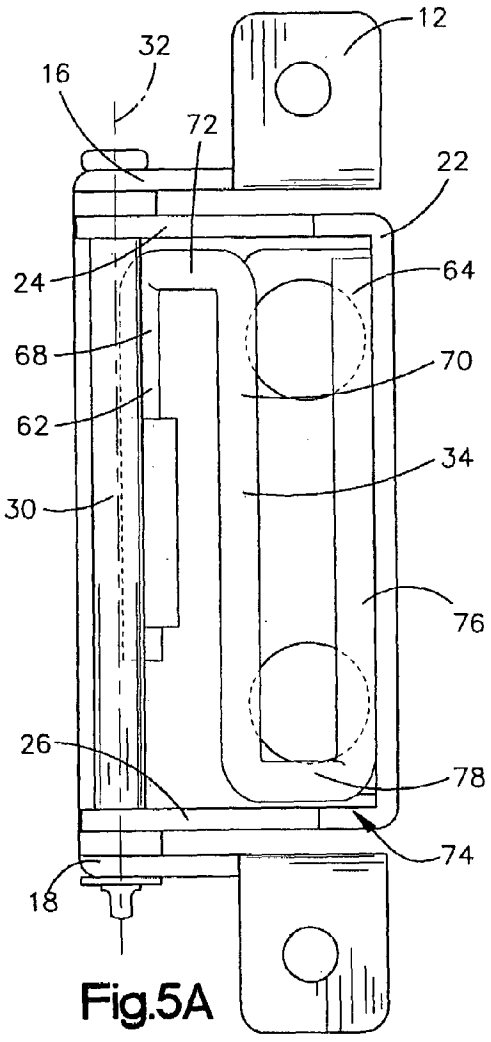
FIGS. 3A, 4A and 5A are front views corresponding to the position of the door assembly shown in FIGS. 3, 4 and 5, respectively.
Figure 3A:
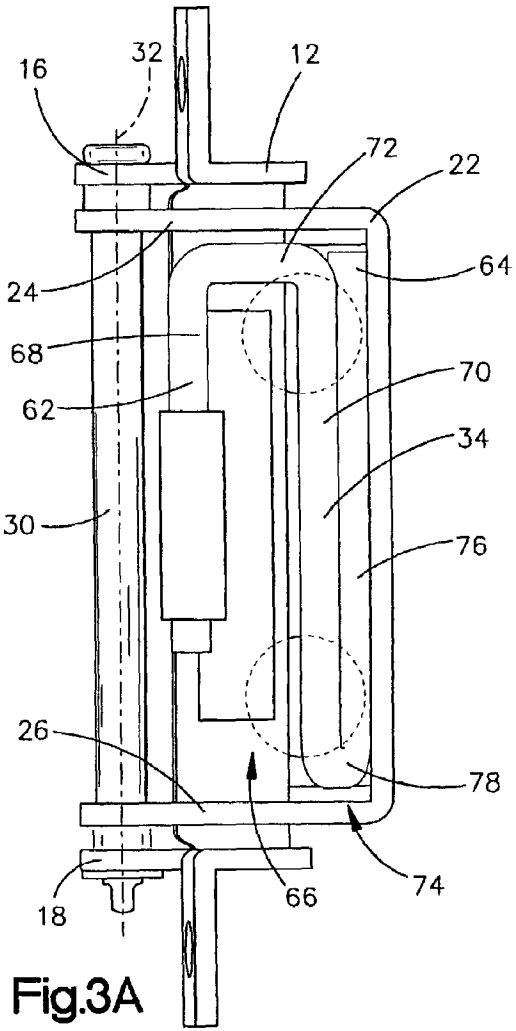

A door assembly 36 includes a door 38 to which a set of hinges is connected (only one hinge of the set being shown). For example, on a vertical door, two hinges can be spaced at the periphery along a vertical side of the door, while on a horizontal door, two hinges can be spaced at the periphery along a horizontal side of the door. The first workpiece may be comprised of the door 38 and the second workpiece may be comprised of a fixed surface 40 of an article to which the door can be pivotally connected. The door assembly preferably comprises a set of hinge cavities 42. The ears 13 of the first bracket can be bolted with fasteners such as nuts and bolts 43 (FIG. 3) to internal door surfaces 44 through aligned holes 45 of the ears and internal surfaces at a periphery 46 of the door. The hinge cavities are configured to receive the hinge pins 30 and a portion of the hinge within the doors effective to enable the hinges to be hidden by the doors in their open and closed positions. The second bracket may include a pre-attached bolt 31 that extends through aligned holes 37 in the second bracket and article, and is secured to the article with nut 33 (FIG. 3).

Various articles comprising the door assembly are covered by the invention, including bodies of motor vehicles, tool boxes, and articles used in any applications in which it is desired to conceal a hinge and/or to employ a door assembly which is biased toward closed and open positions, as discussed below. One preferred article comprising the door assembly of the present invention is a utility body adapted to be mounted to a truck chassis of a utility vehicle comprising body side storage compartment units represented by 48 in FIG. 4 such as described in co-pending patent application entitled "Corrosion-Resistant Body for Utility Vehicle," filed on Apr. 9, 2004, which is incorporated herein by reference in its entirety. The body side storage compartment units comprise door openings 50. The door assembly is pivotally connected to the storage compartment units such that the door 38 covers the door opening 50. An elastomeric, or other water-resistant seal 51 is disposed around the periphery of the door opening as known in the art. The door assembly includes other conventional components such as latches.

Figure 4A:
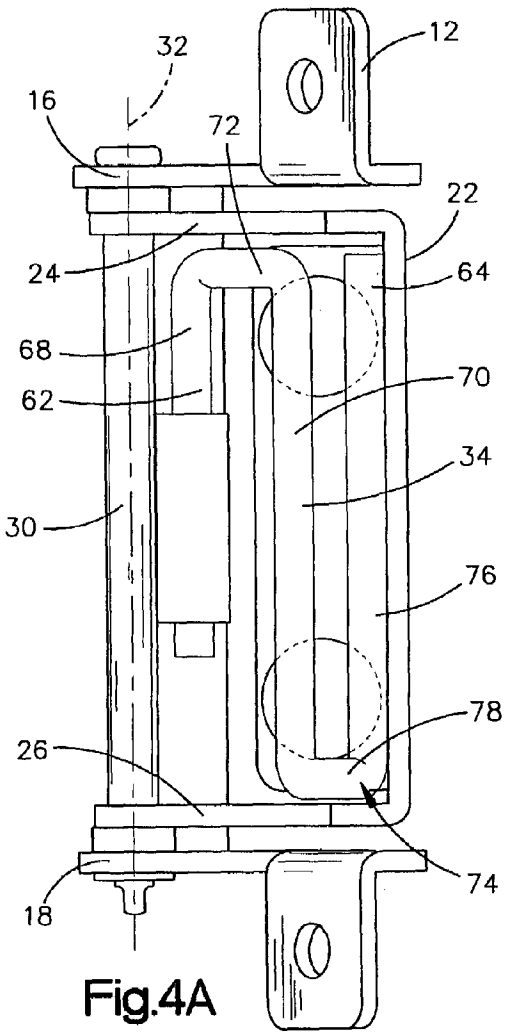
Figure 4:
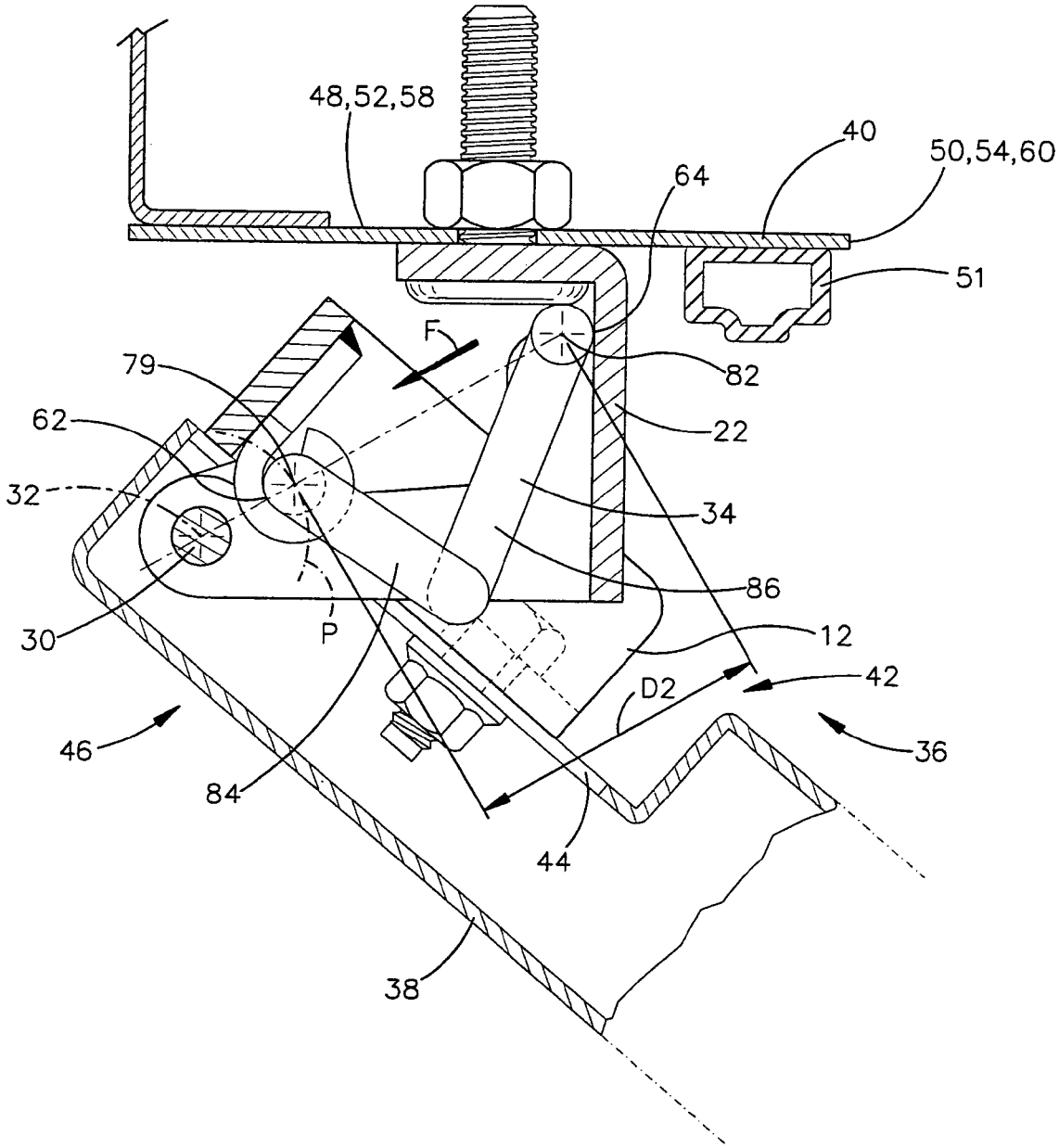

Similarly, the motor vehicle body may be a body of automobiles, trucks, sports utility vehicles and the like, represented by 52 in FIG. 4. The body 52 of the motor vehicle comprises door openings 54. The inventive door assembly is pivotally connected to the body so as to cover the door opening 54. The inventive door assembly is also pivotally connected to a tool box represented by 58 in FIG. 4 so as to cover a door opening 60 of the tool box. The tool box may be adapted to be mounted across a bed of a pick-up truck, for example.

Turning now to a more detailed description of the spring, the spring comprises first and second end portions 62, 64 (FIG. 2). The first end portion 62 is pivotally received in the sleeve 14 and extends generally parallel with the hinge pin. The second end portion 64 contacts the second bracket and extends generally parallel with the hinge pin. In particular, the spring can be made of metal wire such as steel and of a wire geometry and thickness which tends to retain its form and resist deflection. As shown in FIG. 2 the spring comprises a first generally inverted U-shaped portion 66 including a first leg 68, a second leg 70 and a first intermediate portion 72. The first leg 68 is located at the first end portion 62 received by the sleeve. The second leg 70 is generally parallel with the first leg. The first intermediate portion 72 extends transversely between the first and second legs. A second generally U-shaped portion 74 includes the second leg 70, a third leg 76 and a second intermediate portion 78. The third leg 76 is trapped against the second bracket 22 and extends generally parallel to the second leg. The second intermediate portion 78 extends transversely between the second and third legs 70, 76. The first generally inverted U-shaped portion 66 extends at an angle $\alpha$ of about 90 degrees relative to the second generally U-shaped portion 74 to form the generally L-shape in the top views shown in FIGS. 3 and 5 when the spring is in a less compressed or relatively stable state. Those skilled in the art will appreciate in view of this disclosure that the spring can be modified somewhat in thickness, material type and properties and geometry, without departing from the spirit of the invention. For example, the first and second U-shaped portions 66, 74 may extend at angles that are not about 90 degrees.

A center reference line 80 extends transversely between the hinge axis 32 and an axis 82 of the second end portion of the spring. When the first bracket is pivoted relative to the second bracket, the first end portion of the spring 62 disposed in the sleeve travels in a substantially arcuate path P around the hinge pin axis 32 between open and closed positions of the hinge. Movement of the hinge between the open and closed positions that locates an axis 79 of the first spring end portion near the center line 80 reduces a distance D between the first end portion 62 and the second end portion 64, thereby generating a spring force F that urges the first end portion away from the center line and the hinge toward a nearer of the open and closed positions. Assuming no external forces, in a preferred embodiment the spring biases the hinge and door assembly toward the open position when the first end portion of the spring is on the path between the open position and the centerline and the spring biases the hinge and door assembly toward the closed position when the first end portion of the spring is on the path between the centerline and the closed position. Thus, the hinge is biased toward the open and closed positions. When closed, the hinge is biased to remain closed and when open, the hinge is biased to remain open.

The spring is in a somewhat compressed state when the door is fully open and fully closed (hinge over-center), at a lesser state of compression than when the hinge is on center. That is, in the fully open and fully closed positions the position of the hinge is more stable and a lesser spring force is generated from the generally fixed second spring end portion against the first spring end portion. When the hinge is on center, the spring force of the second spring end portion against the first spring end portion is greater and the position of the hinge is less stable, biasing it toward the more stable fully open or fully closed positions. Once the hinge is in the fully open position, closing the hinge requires applying a compressive force of the first spring end portion toward the second spring end portion which exceeds the force exerted by the second spring end portion against the first spring end portion. Conversely, when the spring is in the fully closed position, opening the hinge requires applying a compressive force of the first spring end portion toward the second spring end portion which exceeds the force exerted by the second spring end portion against the first spring end portion.

Turning now to a more detailed discussion of the operation of the spring, in FIG. 3 the door assembly and hinge are in an open position and the spring is in a more stable state. The first side 84 and a second side 86 that compose the L-shape of the spring as seen in the top view of FIG. 3, are generally perpendicular to each other. In closing the door by moving it inwardly, the first end portion 62 moves counterclockwise along the substantially arcuate path P around the hinge pin. This moves the first end portion of the spring 62 from the position of FIG. 3 closer to the second end portion of the spring 64 at the position shown in FIG. 4. That is, the distance D1 between the first and second end portions of the spring is decreased to the shorter distance D2 when the hinge moves from the open position toward a position approximately midway between open and closed positions. Compressing the first spring end portion 62 toward the second end portion 64 results in a spring force in the opposite direction, which tends to move the first end portion clockwise biasing the door toward the open position. In a position approximately midway between the open and closed positions (FIG. 4), the axis 79 of the first spring portion is aligned with the center line 80 (i.e., the hinge is on center).

Figure 5:
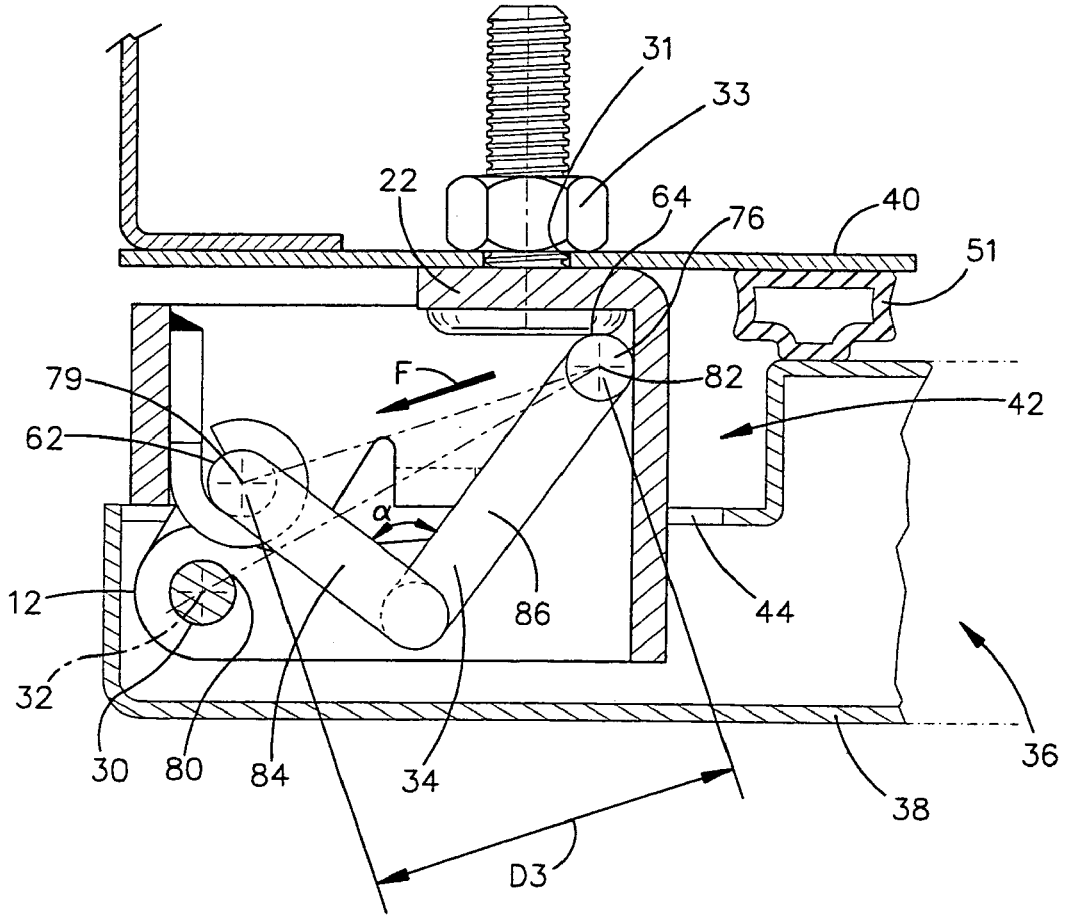

Once the door passes the on-center position near the midpoint between the open and closed positions, as it continues to be closed it moves from approximately the position shown in FIG. 4 toward the position shown in FIG. 5. During this period the first end portion axis 79 continues to travel counter-clockwise along the path P around the hinge axis from the on-center position on the center line (FIG. 4) toward a more inward location (FIG. 5). During this period, the compression on the end portions of the spring progressively relaxes as the first end portion moves away from the second end portion; the distance D2 (FIG. 4) increases to distance D3 (FIG. 5). Therefore, the spring biases the door toward the closed position in which the spring again resumes a less compressed, more stable state (FIG. 5).

The spring behaves in reverse manner when the door is opened. As the door is opened, the first end portion 62 rotates from the position shown in FIG. 5 clockwise along the path P around the hinge axis toward the position shown in FIG. 4. This causes the first spring end portion to be compressed toward the second spring end portion, which is resisted by the spring as represented by force F, and the spring tends to bias the door closed. Once the door is opened over center, past the approximate midpoint shown in FIG. 4, the first end portion of the spring 62 continues to rotate clockwise along the path P around the hinge axis from the centerline 80 toward a more outward position shown in FIG. 3. During this period the distance between the first and second end portions D2 (FIG. 4) increases to D1 (FIG. 3) where the spring is once again in a less compressed, more stable state. Therefore, the spring biases the hinge and door assembly to the open position.

The third leg of the spring that is trapped against the second bracket can pivot several degrees as can be seen in comparing the position of the second L-portion 86 relative to the second bracket in FIGS. 3 and 5.

Figure 6:
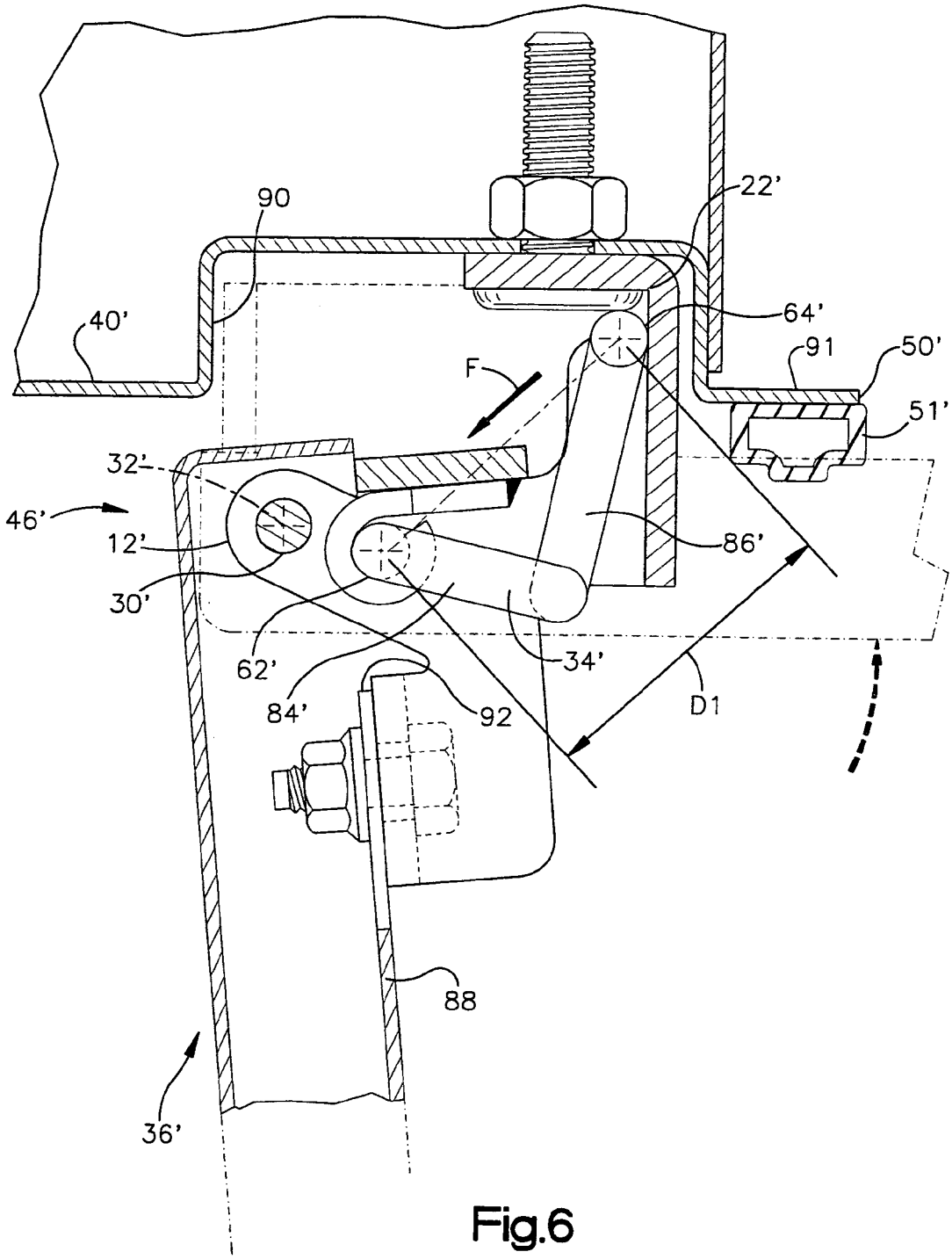
FIG. 6 is a top plan cross-sectional view of a variation of the inventive hinge.

Another embodiment of the present invention is shown in FIG. 6 where like parts are designated by similar reference numerals that have been used previously, except designated with a prime symbol (') to simplify the description. In this embodiment the hinge may be concealed by mounting the first bracket flush with an inner surface 88 of the door. A portion of the hinge is located in a cavity 90 formed in the fixed article to which the hinge is connected. The article may also include a surface 91 for supporting the seal 51'. This design enables an opening 92 to be formed in a periphery of a hollow door for receiving the hinge, rather than using a door constructed with an internal door surface as in the first embodiment. The operation of the hinge is the same as in the previous description.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A hinge biased toward open and closed positions, comprising:

a first bracket adapted to be mounted to a first workpiece, said first bracket comprising a generally tubular sleeve and opposed spaced-apart surfaces including first openings that are aligned with each other;

a second bracket adapted to be mounted to a second workpiece, said second bracket comprising opposed spaced-apart surfaces including second openings that are aligned with each other;

said first bracket and said second bracket being oriented with respect to each other effective to align said first openings with said second openings;

a hinge pin received in said first openings and said second openings effective to enable said first bracket to be pivotally movable relative to said second bracket, said tubular sleeve extending generally parallel with an axis of said hinge pin;

a spring having a serpentine geometry and a generally L-shape in a direction of said hinge pin axis when said spring is in a relatively stable state, said spring comprising first and second end portions, said first end portion being pivotally received in said sleeve and extending generally parallel with said hinge pin and said second end portion contacting said second bracket and extending generally parallel with said hinge pin, a center reference line extending between said hinge axis and an axis of said second end portion of said spring;

wherein when said first bracket is pivoted relative to said second bracket said first end portion of said spring disposed in said sleeve travels in a substantially arcuate path around said hinge pin axis between open and closed positions of the hinge, and movement of said hinge between said open and closed positions that locates said first end portion near said center line reduces a distance between said first end portion and said second end portion thereby generating a spring force that urges said first end portion away from said center line and said hinge toward one of said open and closed positions.

2. The hinge of claim 1 wherein said spring is comprised of metal wire.

3. The hinge claim 1 wherein said spring comprises a first generally inverted U-shaped portion including a first leg at said first end portion received by said sleeve, a second leg that is generally parallel with said first leg and a first intermediate portion extending transversely between said first leg and said second leg, and a second generally U-shaped portion including said second leg, a third leg that contacts said second bracket and extends generally parallel to said second leg and a second intermediate portion extending transversely between said second leg and said third leg, wherein said first generally inverted U-shaped portion extends transversely to said second generally U-shaped portion to form said generally L-shape when said spring is in a relatively stable state.

4. A door assembly comprising the hinge of claim 1 comprising a door to which a set of said hinges is connected, wherein said first workpiece is comprised of said door and said second workpiece is a surface to which said door can be pivotally connected.

5. The door assembly of claim 4 comprising a set of hinge cavities in internal surfaces of a periphery of said door, said hinge cavities being configured to receive said hinge pins within said door effective to enable said hinges to be hidden by said door in open and closed positions of said door.

6. An article comprising said door assembly of claim 4.

7. The article of claim 6 wherein said article is a utility body adapted to be mounted to a truck chassis of a utility vehicle comprising body side storage compartment units, said storage compartment units comprising door openings, each said door assembly being pivotally connected to said storage compartment units so as to cover said door openings.

8. The article of claim 6 wherein said article is a body of a motor vehicle comprising door openings, each said door assembly being pivotally connected to a surface of said body so as to cover one of said door openings.

9. The article of claim 6 wherein said article is a tool box, said tool box forming a door opening, said door assembly being pivotally connected to said tool box so as to cover said door opening.

10. The article of claim 9 wherein said tool box is adapted to be mounted across a bed of a pick-up truck.

11. A utility body adapted to be mounted to a truck chassis of a utility vehicle comprising:

body side storage compartment units comprising door openings;

doors that cover said door openings, each said door including a set of hinge cavities in internal surfaces of a periphery of said door;

hinges that pivotally connect said doors to said storage compartment units with a bias toward open and closed positions, each of said hinges comprising:

a first bracket mounted to said door, said first bracket comprising a generally tubular sleeve and opposed spaced-apart surfaces including first openings that are aligned with each other;

a second bracket mounted to said storage compartment units, said second bracket comprising opposed spaced-apart surfaces including second openings that are aligned with each other;

said first bracket and said second bracket being oriented with respect to each other effective to align said first openings with said second openings;

a hinge pin received in said first openings and said second openings effective to enable said first bracket to be pivotally movable relative to said second bracket, said tubular sleeve extending generally parallel with an axis of said hinge pin;

a spring having a serpentine geometry and a generally L-shape along a direction of said hinge pin axis when said spring is in a relatively stable state, said spring comprising first and second end portions, said first end portion being pivotally received in said sleeve and extending generally parallel with said hinge pin and said second end portion contacting said second bracket and extending generally parallel with said hinge pin, a center reference line extending between said hinge axis and an axis of said second end portion of said spring;

wherein when said first bracket is pivoted relative to said second bracket said first end portion of said spring disposed in said sleeve travels in a substantially arcuate path around said hinge pin axis between open and closed positions of the hinge, and movement of said hinge between said open and closed positions that locates said first end portion near said center line reduces a distance between said first end portion and said second end portion thereby generating a spring force that urges said first end portion away from said center line and said hinge toward one of said open and closed positions;

wherein said hinge cavities are configured to receive said hinge pins within said doors effective to enable said hinges to be hidden by said doors in open and closed positions of said doors.

12. The utility body of claim 11 wherein said spring is comprised of metal wire.

13. The utility body of claim 11 wherein said spring comprises a first generally inverted U-shaped portion including a first leg at said first end portion received by said sleeve, a second leg that is generally parallel with said first leg and a first intermediate portion extending transversely between said first leg and said second leg, and a second generally U-shaped portion including said second leg, a third leg that contacts said second bracket and extends generally parallel to said second leg and a second intermediate portion extending transversely between said second leg and said third leg, wherein said first generally inverted U-shaped portion extends transversely to said second generally U-shaped portion to form said generally L-shape when said spring is in the relatively stable state.

14. A hinge biased toward open and closed positions, comprising:

a first bracket adapted to be mounted to a first workpiece, said first bracket comprising a generally tubular sleeve and opposed spaced-apart surfaces including first openings that are aligned with each other;

a second bracket adapted to be mounted to a second workpiece, said second bracket comprising opposed spaced-apart surfaces including second openings that are aligned with each other;

said first bracket and said second bracket being oriented with respect to each other effective to align said first openings with said second openings;

a hinge pin received in said first openings and said second openings effective to enable said first bracket to be pivotally movable relative to said second bracket, said generally tubular sleeve extending generally parallel with an axis of said hinge pin;

a spring having a serpentine geometry and a generally L-shape in a direction of said hinge pin axis when said spring is in a relatively stable state, said spring comprising first and second end portions, said first end portion being pivotally received in said generally tubular sleeve and said second end portion being connected to said second bracket in a fixed position, said first end portion and said second end portion extending generally parallel with said hinge pin axis, a center reference line extending between said hinge pin axis and an axis of said second end portion of said spring;

wherein when said first bracket is pivoted relative to said second bracket said first end portion of said spring disposed in said generally tubular sleeve travels in a substantially radial path around said hinge pin axis and intersects said center line between open and closed positions of the hinge, and movement of said hinge between said open and closed positions that locates said first end portion near said center line reduces a distance between said first end portion and said second end portion thereby generating a spring force that urges said first end portion away from said center line and said hinge toward one of said open and closed positions.

* * * * *